US010458189B2

(12) United States Patent
Evans

(10) Patent No.: US 10,458,189 B2
(45) Date of Patent: Oct. 29, 2019

(54) EARTH-BORING TOOLS UTILIZING SELECTIVE PLACEMENT OF POLISHED AND NON-POLISHED CUTTING ELEMENTS, AND RELATED METHODS

(71) Applicant: Baker Hughes, a GE company, LLC, Houston, TX (US)

(72) Inventor: Kenneth R. Evans, Spring, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 301 days.

(21) Appl. No.: 15/417,499

(22) Filed: Jan. 27, 2017

(65) Prior Publication Data

US 2018/0216410 A1 Aug. 2, 2018

(51) Int. Cl.

| | |
|---|---|
| ***E21B 10/55*** | (2006.01) |
| ***E21B 3/00*** | (2006.01) |
| ***E21B 10/42*** | (2006.01) |
| ***E21B 10/54*** | (2006.01) |
| ***E21B 10/62*** | (2006.01) |

(52) U.S. Cl.

CPC ..... *E21B 10/55* (2013.01); *E21B 3/00* (2013.01); *E21B 10/42* (2013.01); *E21B 10/54* (2013.01); *E21B 10/62* (2013.01)

(58) Field of Classification Search

CPC ..... E21B 10/54; E21B 10/55; E21B 10/62; E21B 3/00; E21B 10/42; E21B 2010/561; E21B 10/567

See application file for complete search history.

(56) References Cited

U.S. PATENT DOCUMENTS

| | | | |
|---|---|---|---|
| 4,792,001 | A | 12/1988 | Zijsling |
| 5,377,773 | A | 1/1995 | Tibbitts |
| 5,447,208 | A | 9/1995 | Lund et al. |
| 5,549,171 | A | 8/1996 | Mensa-Wilmot et al. |
| 5,605,198 | A | 2/1997 | Tibbitts et al. |
| 5,607,024 | A | 3/1997 | Keith et al. |
| 5,653,300 | A | 8/1997 | Lund et al. |
| 5,787,022 | A | 7/1998 | Tibbitts et al. |
| 5,937,958 | A | 8/1999 | Mensa-Wilmot et al. |

(Continued)

OTHER PUBLICATIONS

International Search Report for International Application No. PCT/US2018/014202 dated May 1, 2018, 5 pages.

(Continued)

*Primary Examiner* — Brad Harcourt
(74) *Attorney, Agent, or Firm* — TraskBritt

(57) ABSTRACT

An earth-boring tool includes a body having a longitudinal axis. The earth-boring tool also includes blades extending longitudinally and generally radially from the body. The earth-boring tool may also include one or more polished superabrasive cutting elements located on at least one blade in at least one region of a face of the earth-boring tool, and one or more non-polished superabrasive cutting elements located on the at least one blade in at least another region of the face of the earth-boring tool. Methods include drilling a subterranean formation including engaging a formation with one or more polished superabrasive cutting elements and one or more non-polished superabrasive cutting elements of the earth-boring tool secured at selected locations of one or more regions of blades extending from a body of the earth-boring tool.

20 Claims, 6 Drawing Sheets

(56) References Cited

U.S. PATENT DOCUMENTS

| | | | | |
|---|---|---|---|---|
| 5,960,896 | A | 10/1999 | Barr et al. | |
| 6,000,483 | A | 12/1999 | Jurewidz et al. | |
| 6,145,608 | A | 11/2000 | Lund et al. | |
| 6,298,930 | B1 | 10/2001 | Sinor et al. | |
| 6,460,631 | B2 | 10/2002 | Dykstra et al. | |
| 7,000,715 | B2 | 2/2006 | Sinor et al. | |
| 7,814,997 | B2 | 10/2010 | Aliko et al. | |
| 8,141,665 | B2 | 3/2012 | Ganz | |
| 8,919,462 | B2 | 12/2014 | DiGiovanni et al. | |
| 8,991,525 | B2 | 3/2015 | Bilen et al. | |
| 9,359,826 | B2 | 6/2016 | Do et al. | |
| 9,376,867 | B2 | 6/2016 | DiGiovanni et al. | |
| 9,476,257 | B2 | 10/2016 | Bilen et al. | |
| 2006/0278436 | A1 | 12/2006 | Dykstra et al. | |
| 2010/0276200 | A1 | 11/2010 | Schwefe et al. | |
| 2012/0186879 | A1 | 7/2012 | Durairajan et al. | |
| 2013/0306377 | A1* | 11/2013 | DiGiovanni ..... | E21B 10/5673 175/65 |
| 2014/0262540 | A1* | 9/2014 | Scott ..... | E21B 10/5735 175/428 |
| 2015/0233185 | A1 | 8/2015 | Maouche et al. | |
| 2016/0069140 | A1 | 3/2016 | Patel et al. | |
| 2017/0022763 | A1 | 1/2017 | Schwefe et al. | |

OTHER PUBLICATIONS

International Written Opinion for International Application No. PCT/US2018/014202 dated May 1, 2018, 9 pages.

* cited by examiner

EARTH-BORING TOOLS UTILIZING SELECTIVE PLACEMENT OF POLISHED AND NON-POLISHED CUTTING ELEMENTS, AND RELATED METHODS

TECHNICAL FIELD

Embodiments of the present disclosure relate to earth-boring tools utilizing selective placement of polished and non-polished cutting elements, and related methods.

BACKGROUND

Earth-boring tools are used to form boreholes (e.g., wellbores) in subterranean formations. Such earth-boring tools include, for example, drill bits, reamers, mills, etc. For example, a fixed-cutter earth-boring rotary drill bit (often referred to as a "drag" bit) generally includes a plurality of cutting elements secured to a face of a bit body of the drill bit. The cutting elements are fixed in place when used to cut formation materials. A conventional fixed-cutter earth-boring rotary drill bit includes a bit body having generally radially projecting and longitudinally extending blades. During drilling operations, the drill bit is positioned at the bottom of a well borehole and rotated as weight-on-bit (WOB) is applied.

A plurality of cutting elements is positioned on each of the blades. The cutting elements commonly comprise a "table" of superabrasive material, such as mutually bound particles of polycrystalline diamond, formed on a supporting substrate of a hard material, such as cemented tungsten carbide. Such cutting elements are often referred to as "polycrystalline diamond compact" (PDC) cutting elements. The plurality of PDC cutting elements may be fixed within cutting element pockets formed in rotationally leading surfaces of each of the blades. Conventionally, a bonding material, such as a braze alloy, may be used to secure the cutting elements to the bit body.

For directional drilling of nonlinear borehole segments, the face aggressiveness (i.e., aggressiveness of the cutters disposed on the blades over the face of the bit body) is a significant feature in terms of acceptable performance of the bit, since it is largely determinative of how a given bit responds to sudden variations in bit load. Unlike roller cone bits, rotary drill bits employing the PDC cutters are very sensitive to load, which sensitivity is reflected in much steeper rate-of-penetration (ROP) versus WOB and torque-on-bit (TOB) versus WOB relationships. Such high WOB sensitivity causes problems in directional drilling. Adjustments may be made to the bit structure in order to increase drilling efficiency while reducing mechanical specific energy (MSE) (i.e., the amount of force required to remove a given volume of rock). In particular, specific structural adjustments may be made in order to affect response to WOB and Aggressiveness ("Mu" or $\mu$), which in turn affect build-up-rate (BUR). Conventional methods to improve rotary drill bit face aggressiveness include adjustments to cutter densities, cutter back rakes, blade number and configurations, and, significantly, the addition of depth-of-cut control (DOCC) structures to the face of the drill bit, particularly within the cone region.

The Assignee of the present disclosure and application has developed and implemented various approaches to the use of DOCC structures, as disclosed, for example, in U.S. Pat. Nos. 6,298,930 and 6,460,631, assigned to the Assignee herein, the disclosure of each of which is incorporated herein in its entirety by this reference. As is appreciated by one of ordinary skill in the art, the placement of DOCC structures within the cone region, while effective, has proven somewhat difficult to implement in smaller diameter bits, and in bits with relatively blade small widths in the rotational direction, as measured between rotationally leading and trailing sides of the blades. Such bits may not offer enough blade material and, thus, strength, to accommodate an aperture formed in an axially leading surface of a blade for holding a DOCC element. Certain solutions have been proposed and implemented to address this issue, examples including embodiments of preformed blade components disclosed in U.S. Pat. No. 7,814,997, the disclosure of which is incorporated herein in its entirety by this reference. Such solutions, while effective in some situations, add to the manufacturing cost of a bit. Other solutions, such as forming DOC limiters in the material, such as matrix material, of a leading surface of a blade simultaneous with forming a bit body as disclosed in U.S. Pat. No. 8,141,665, the disclosure of which is incorporated herein in its entirety by this reference, present issues with exposure control of the DOC limiters as well as constraints on the material of the DOC limiter.

BRIEF SUMMARY

In one embodiment of the disclosure, an earth-boring tool includes a body having a longitudinal axis. The earth-boring tool also includes blades extending longitudinally and generally radially from the body. The earth-boring tool may also include one or more polished superabrasive cutting elements located on at least one blade in at least one region of a face of the earth-boring tool and one or more non-polished superabrasive cutting elements located on the at least one blade in at least another region of a face of the earth-boring tool.

In another aspect of the disclosure, a method of drilling a subterranean formation includes applying weight-on-bit to an earth-boring tool substantially along a longitudinal axis thereof and rotating the earth-boring tool, and engaging a formation with one or more polished superabrasive cutting elements and one or more non-polished superabrasive cutting elements of the earth-boring tool secured at selected locations of one or more regions of blades extending from a body of the earth-boring tool.

BRIEF DESCRIPTION OF THE DRAWINGS

While the specification concludes with claims particularly pointing out and distinctly claiming what are regarded as embodiments of the present disclosure, various features and advantages of disclosed embodiments may be more readily ascertained from the following description when read with reference to the accompanying drawings, in which:

DETAILED DESCRIPTION

Figure 1:
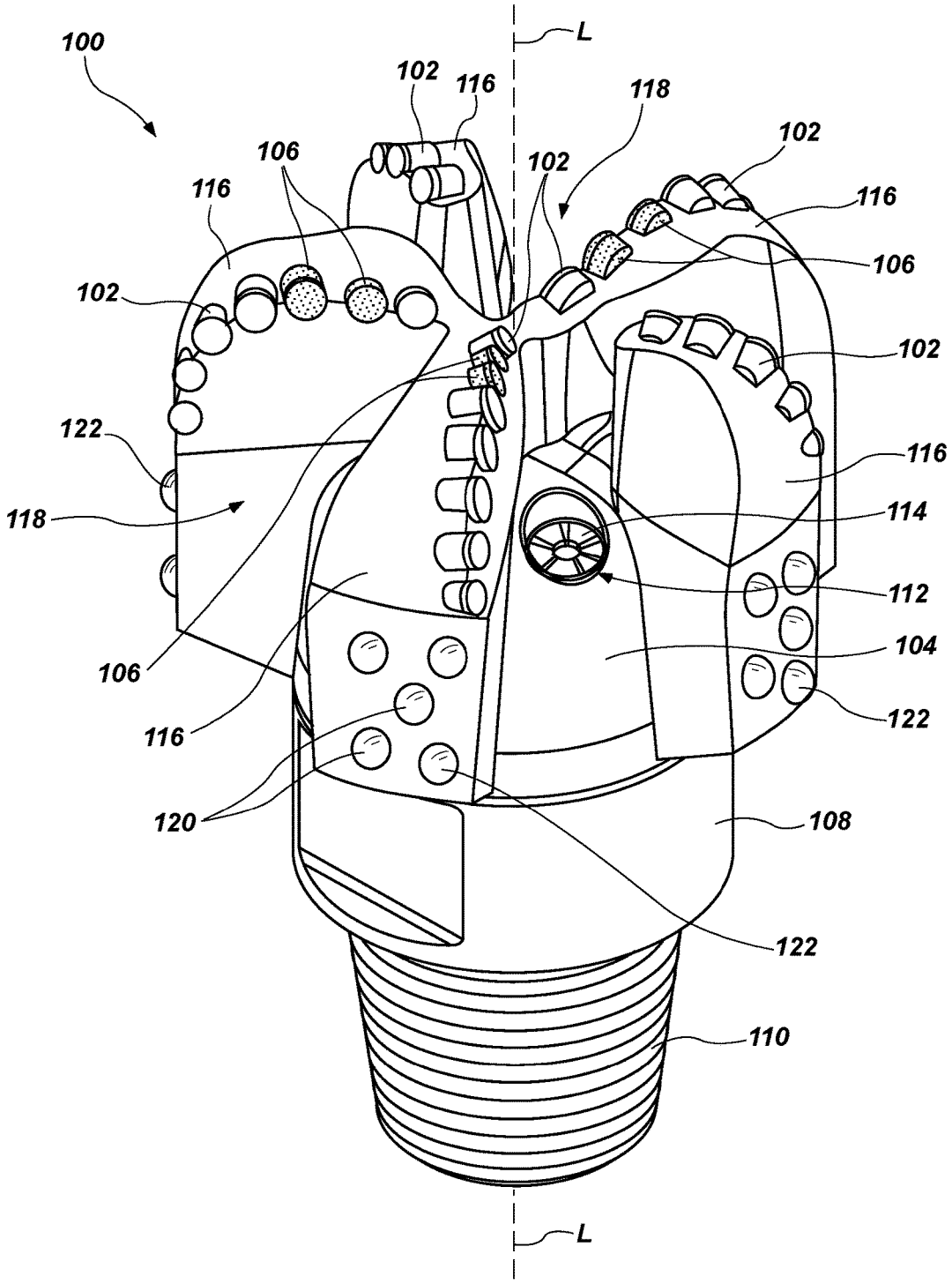
FIG. 1 is a perspective view of an earth-boring drill bit including polished and non-polished cutting elements of the disclosure.

The illustrations presented herein are not actual views of any particular earth-boring tool, drill bit, cutting element, or component of such a tool or bit, but are merely idealized representations that are employed to describe embodiments of the present disclosure.

As used herein, the term "earth-boring tool" means and includes any tool used to remove formation material and form a bore (e.g., a wellbore) through the formation by way of removing the formation material. Earth-boring tools include, for example, rotary drill bits (e.g., fixed-cutter or "drag" bits and roller cone or "rock" bits), hybrid bits including both fixed cutters and roller elements, coring bits, bi-center bits, reamers (including expandable reamers and fixed-wing reamers), and other so-called "hole-opening" tools, etc.

As used herein, the term "cutting element" means and includes any element of an earth-boring tool that is configured to cut or otherwise remove formation material when the earth-boring tool is used to form or enlarge a bore in the formation. In particular, "cutting element," as that term is used herein with regards to implementation of embodiments of the present disclosure, means and includes PDC cutting elements.

As used herein, the term "polished," and any derivative thereof, when used to describe a condition of a surface of a volume of superabrasive material of a cutting element, means and includes a surface having a surface finish roughness less than about 10 μin. (about 0.254 μm) root mean square (RMS) (all surface finishes referenced herein being RMS), for example about 5 μin. (about 0.127 μm).

As used herein, the term "non-polished," and any derivative thereof, when used to describe a condition of a volume of superabrasive material of a cutting element, means and includes a surface having a surface finish of greater than about 20 μin. (about 0.508 μm), for example, about 40 μin. (about 1.02 μm) or greater.

As used herein, the term "bearing element" means an element configured to be mounted on a body of an earth-boring tool, such as a drill bit, and to rub against a formation as the body of the earth-boring tool is rotated within a wellbore. Bearing elements include, for example, what are referred to in the art as depth-of-cut control (DOCC) elements, or structures. Bearing elements do not include conventional PDC cutting elements configured to cut formation material by a shearing mechanism.

As used herein, the term "substantially" in reference to a given parameter means and includes to a degree that one skilled in the art would understand that the given parameter, property, or condition is met with a small degree of variance, such as within acceptable manufacturing tolerances. For example, a parameter that is substantially met may be at least about 90% met, at least about 95% met, or even at least about 99% met.

A variety of approaches have been employed for forming a subterranean borehole. One conventional approach used to form a subterranean borehole includes employing a rotary drill bit including PDC cutting elements that may shear formation material and including bearing structures that may limit the depth-of-cut (DOC) of the cutting elements, protect the cutting elements from excessive contact with the formation, enhance (e.g., improve) lateral stability of the tool, or perform other functions or combinations of functions. This arrangement permits the use of one or more bearing structures (e.g., an ovoid or a non-cutting rubbing surface) on axially leading surfaces of the bit blades to limit DOC as well as effectively stabilizing the rotary drill bit during a drilling operation (e.g., during directional drilling). The Assignee of the present disclosure has, to this end, designed so called "formation-engaging structures" as bearing elements received in apertures in axially leading blade surfaces, which structures generally limit DOC. U.S. Pat. Nos. 9,359,826 and 9,476,257, each of which are assigned to the Assignee of the present disclosure, and the disclosure of each of which is incorporated herein in its entirety by this reference, disclose formation-engaging structures disposed within receptacles of a body of an earth-boring tool.

Such structures may help control Aggressiveness (μ), which could influence tool face, which in turn affects build-up-rate (BUR), but the structures may also contribute to decreased efficiency of the bit during drilling. Thus, an increase in mechanical specific energy (MSE) may be required to compensate for the decreased efficiency due, at least in part, to the presence of the DOC structures. However, it has since been recognized by the inventor herein that providing increased directional control by utilizing selective placement of cutting elements for DOC control, including both maximum DOC and limitation of DOC variability, may enable increased WOB to be applied without the bit experiencing loss of efficiency. As a result, continuously achievable ROP may be optimized and TOB controlled even under high WOB, while destructive loading of the PDC cutters is largely prevented. Further, smaller bits (e.g., 6.5 inch diameter or less drill bits) may have limited blade surface area and/or material volume for DOC features, such as DOCC structures or other non-cutting rubbing surfaces. Therefore, improvements in providing DOC control using selective placement of non-polished cutting elements in combination with polished cutting elements on the face of the bit may provide previously unrecognized benefits and advantages over bits including such DOC features, which advantages may be particularly significant in directional drilling.

FIG. 1 is a perspective view of an embodiment of an earth-boring tool 100 of the present disclosure. The earth-boring tool 100 of FIG. 1 is configured as an earth-boring rotary drill bit. The earth-boring tool 100, more specifically, comprises a drag bit having a plurality of polished cutting elements 102 affixed to a body 104 of the earth-boring tool 100. The earth-boring tool 100 also includes one or more non-polished cutting elements 106 affixed to the body 104. The present disclosure relates to embodiments of earth-boring tools including the non-polished cutting elements 106 to enable DOC control with minimizing the potential of increased MSE in order to compensate for loss of efficiency during drilling operations. The non-polished cutting elements 106 may be selectively placed in specific regions (e.g., cone, nose, or shoulder regions) of the body 104 in order to facilitate DOC control, as discussed in further detail below.

The body 104 of the earth-boring tool 100 may be secured to a shank 108 having a threaded connection portion 110, which may conform to industry standards, such as those promulgated by the American Petroleum Institute (API), for attaching the earth-boring tool 100 to a drill string (not shown). The body 104 may include internal fluid passageways that extend between fluid ports 112 at the face of the body 104 and a longitudinal bore that extends through the shank 108 and partially through the body 104. Nozzle inserts 114 may be secured within the fluid ports 112 of the internal fluid passageways. The body 104 may include a plurality of blades 116 that are separated by fluid courses 118, portions of which, along the gage of the earth-boring tool 100, may be referred to in the art as "junk slots." In some embodiments, the body 104 may include gage wear plugs 120, wear knots 122, or both.

Each non-polished cutting element 106 may be positioned on a blade 116 in a selected region (e.g., cone region) and may or may not be located proximate to at least one or more polished cutting elements 102. In some embodiments, the non-polished cutting elements 106 may be positioned exclusively in the cone region, as shown in FIG. 1. In such a configuration, the non-polished cutting elements 106 may be located proximate a longitudinal axis L of the body 104. For example, the non-polished cutting elements 106 may be positioned within second and third radially innermost pockets of a given blade 116. In addition, a single polished cutting element 102 may be located between the two non-polished cutting elements 106 and the longitudinal axis L of the body 104 and may be positioned within a first radially innermost pocket of the given blade 116. In other embodiments, the cutting elements 102, 106 may be selectively located in differing configurations within the cone region. In yet other embodiments, the non-polished cutting elements 106 may be disposed at selected positions within other regions (e.g., nose, shoulder, or gage regions) of the body 104. In addition, the non-polished cutting elements 106 may be located along the leading edge of the blade 116 and may be linearly adjacent to the polished cutting elements 102 that are also located along the leading edge of the blade 116. In other embodiments, the non-polished cutting elements 106 may be disposed at selected positions rotationally following or rotationally leading the polished cutting elements 102. In some embodiments, back rakes of polished cutting elements 102 and non-polished cutting elements 106 in at least the nose and cone regions of the bit face may be substantially the same.

In some embodiments, the non-polished cutting elements 106 may provide DOC control without the aid of additional DOCC bearing elements. For example, the blades 116 of the body 104 may be entirely free of non-cutting bearing elements, such as DOCC structures or other non-cutting rubbing structures. Stated another way, the non-polished cutting elements 106 may be positioned and configured within a leading edge of a blade 116 to engage a formation while also providing exclusive DOC control. In such a configuration, the axially leading surface of a blade 116 may be entirely free of non-cutting bearing elements and/or DOC features. In other embodiments, such non-cutting bearing elements may be provided for DOC control in selected locations on one or more blades 116 in addition to the non-polished cutting elements 106. Non-limiting examples of DOCC structures include ovoids or other bearing elements placed in apertures in the blades, protrusions formed in blade material and extending therefrom, and pre-formed blade components incorporated in blades and including protruding bearing elements, as previously discussed herein. It may be appreciated that any combination of the polished cutting elements 102, the non-polished cutting elements 106, and/or non-cutting bearing elements may be utilized in combination in order to provide specific benefits for increased efficiency during drilling operations of various subterranean formations.

The non-polished cutting elements 106 may comprise PDC cutting elements including a diamond table secured to a supporting substrate. It is also contemplated that the table may, alternatively be formed of cubic boron nitride. In some embodiments, the non-polished cutting elements 106 may each comprise a, disc-shaped diamond table on an end surface of a generally cylindrical cemented carbide substrate and having a substantially planar cutting face opposite the substrate. In other embodiments, the cutting face topography of the cutting faces of the non-polished cutting elements 106, or portions thereof, may be non-planar.

Similarly, the polished cutting elements 102 may comprise PDC cutting elements including a diamond table secured to a supporting substrate. It is also contemplated that the table may, alternatively be formed of cubic boron nitride. The cutting faces of the polished cutting elements 102 may also be substantially planar. However, the cutting faces or portions thereof may be non-planar. Additionally, an outer surface (e.g., cutting face) of the diamond table of the polished cutting elements 102 may be physically modified, such as by polishing to a smooth or mirrored finish. For example, cutting faces of the diamond tables of the polished cutting elements 102 may exhibit a reduced surface roughness, such as described in U.S. Pat. No. 6,145,608, issued Nov. 14, 2000 to Lund et al.; U.S. Pat. No. 5,653,300, issued Aug. 5, 1997 to Lund et al.; and U.S. Pat. No. 5,447,208, issued Sep. 5, 1995 to Lund et al. each of which patents is assigned to the Assignee of the present application, and the disclosure of each of which is incorporated herein in its entirety by this reference.

In conventional PDC cutting elements, such as, for example, the non-polished cutting elements 106, a cutting face or leading face of PDC may be lapped to a surface finish of about 20 μin. (about 0.508 μm) to about 40 μin. (about 1.02 μm) or greater, root mean square RMS (all surface finishes referenced herein being RMS), which is relatively smooth to the touch and visually planar (if the cutting face is itself flat), but which includes a number of surface anomalies and exhibits a degree of roughness which is readily visible to one even under very low power magnification, such as a 10× jeweler's loupe. However, an outer surface of the diamond table of the polished cutting elements 102 may be treated to exhibit a greatly reduced surface roughness. As a non-limiting example, an outer surface, such as a cutting face, of the diamond tables of the polished cutting elements 102 may exhibit a surface finish roughness less than about 10 μin. (about 0.254 μm) RMS. In other embodiments, an outer surface, such as a cutting face, of the diamond tables of the polished cutting elements 102 may be polished to a surface roughness of about 0.5 μin. (about 0.0127 μm) RMS, approaching a true "mirror" finish.

In view of the foregoing, selected surfaces of the diamond table of the polished cutting elements 102 may be polished or otherwise smoothed to have a reduced surface roughness relative to a surface roughness of the non-polished cutting elements 106. In some embodiments, the substantially planar surfaces and/or non-planar surfaces cutting faces of the polished cutting elements 102 may exhibit such a reduced surface roughness. In further embodiments, an entire cutting face, including at least one chamfered region extending at least partially about a circumferential periphery thereof and/or lateral side surfaces, of the polished cutting elements 102 may exhibit such a reduced surface roughness. In other words, any or all of the exposed surfaces of the polished cutting elements 102 may exhibit a quantifiable, reduced surface roughness relative to a surface roughness of the non-polished cutting elements 106.

The so called "polished" cutting face may exhibit favorable performance characteristics as the polished cutting elements 102 shear formation material from the formation being cut, including, for example, the shearing of formation chips of uniform thickness that slide in a substantially unimpeded manner up the cutting face of the cutting element instead of agglomerating as a mass on the cutting face, accumulating in a fluid course rotationally ahead of the cutting element and potentially causing "balling" of formation material on the tool face, resulting in severe degradation of drilling performance of the earth-boring tool 100. Thus, the polished cutting elements 102 may be particularly suited to placement on relatively low load areas of the body 104 where enhanced cutting efficiency is required, such as on the nose, shoulder, and gage regions of the body 104, while the non-polished cutting elements 106 may be particularly suited to placement on high load areas of the body 104, such as on a region of the body 104 proximate the longitudinal axis L (i.e., cone region) where there are relatively high forces on the cutting elements due to low cutter redundancy at a given radius on the face of the body 104 and individual cutting elements have a greater area of cut. In some of these embodiments, polished cutting elements 102 may also be placed in high load areas of the body 104. For example, a single polished cutting element 102 may be positioned within the first radially innermost pocket of a blade 116 in order to avoid or reduce the potential for balling of formation material at the center of the body 104 where fluid flow is minimal. Accordingly, the cutting elements 102, 106 according to various embodiments of the present disclosure may be placed on the face of the body 104 in consideration of the work demanded of a cutter at a given location, in combination with bit hydraulics.

Conventionally, non-cutting bearing elements, characterized as DOCC structures, have been used to limit DOC of cutters, such as the polished cutting elements 102. However, in embodiments of the present disclosure, additional cutting elements, such as the non-polished cutting elements 106, may serve to limit the DOC of the polished cutting elements 102 in lieu of DOCC structures. Drilling characteristics of a particular bit, such as DOC, may be enhanced by selection of the number and placement of the non-polished cutting elements 106 relative to the number and placement of the polished cutting elements 102. It is contemplated that cutting elements 102, 106 may exhibit substantially the same exposures relative to one another. In addition, as polished cutting elements 102 are replaced with non-polished cutting elements 106, a common back rake angle between the cutting elements 102, 106 may be maintained. In other words, an original bit design may not change with the exception of substituting polished cutting elements 102 with non-polished cutting elements 106 in selected locations (e.g., cone region) of the body 104, and omission of conventional DOCC structures.

Figure 2:
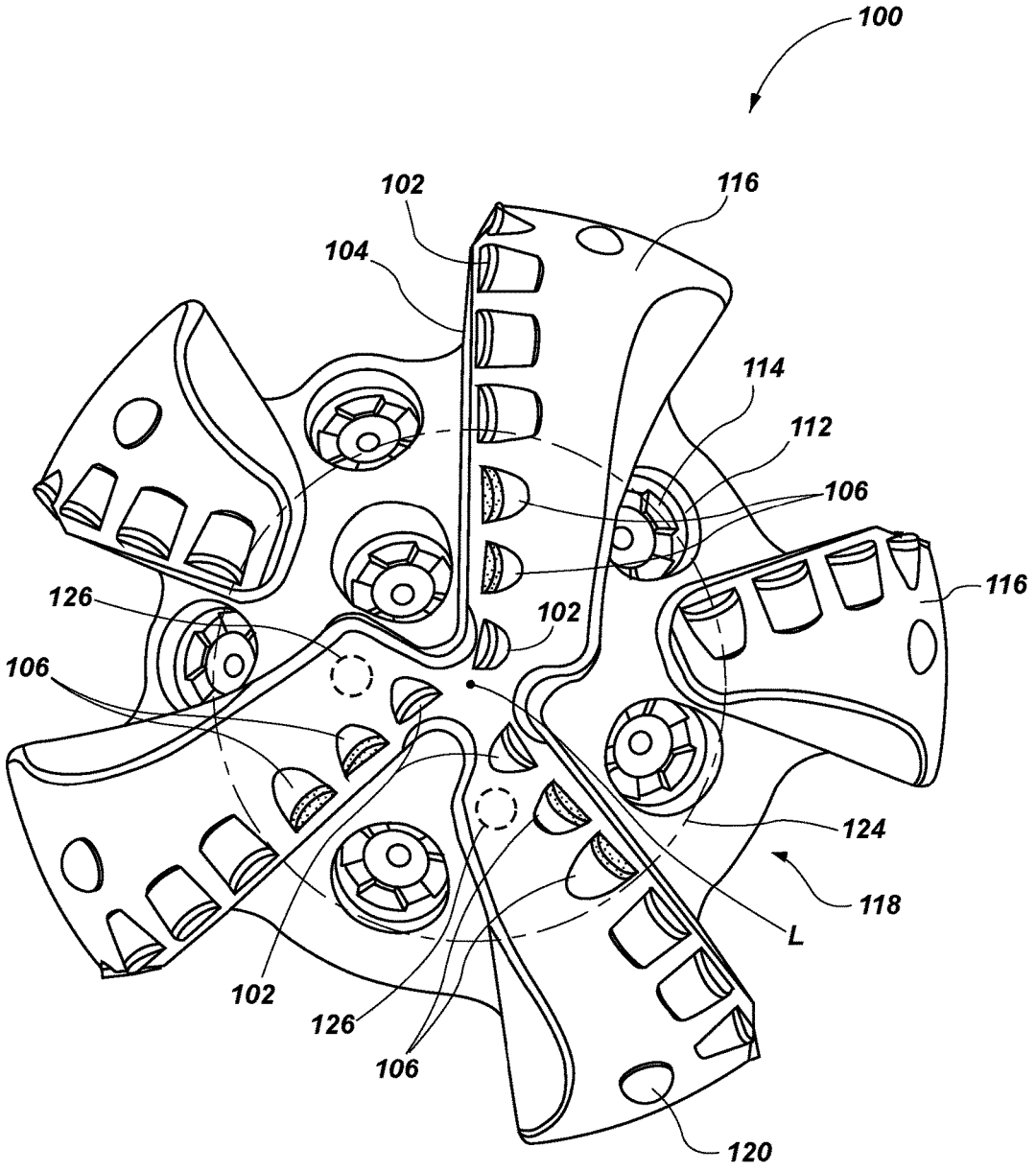
FIG. 2 is a face view of the earth-boring drill bit of the disclosure.

FIG. 2 is a face view illustrating the earth-boring tool 100 of FIG. 1. As discussed above, the earth-boring tool 100 comprises a drag bit having the plurality of polished cutting elements 102 disposed within pockets of the plurality of blades 116 of the body 104. The earth-boring tool 100 also includes one or more non-polished cutting elements 106 disposed within pockets of the plurality of blades 116. In some embodiments, the body 104 may also include the gage wear plugs 120 on, for example, the shoulder region of the blades 116. For purposes of illustration, the cone region of the body 104 is shown in FIG. 2 as being enclosed by dashed line 124. In some embodiments, the non-polished cutting elements 106 may lie entirely within the cone region enclosed by the dashed line 124. In such a configuration, the non-polished cutting elements may be positioned within second and third radially innermost pockets of each of the three major blades and may be located proximate to the longitudinal axis L of the body 104, providing a total of six of the non-polished cutting elements 106 in the cone region. In addition, a single polished cutting element 102 may be located radially between the non-polished cutting elements 106 and the longitudinal axis L of the body 104 and may be positioned within a first radially innermost pocket of each blade 116. In other words and by way of example only, six of the polished cutting elements 102 may be replaced with six of the non-polished cutting elements 106 in the cone region of the body 104, while the radially innermost pocket proximate the longitudinal axis L along with other pockets in one or more radially outward regions (e.g., nose, shoulder, or gage regions) of the blades 116 may contain the polished cutting elements 102. In other embodiments, nine of the polished cutting elements 102 may be replaced with nine of the non-polished cutting elements 106 in or near the cone region of the body 104. In yet other embodiments, all cutter locations (e.g., pockets) enclosed within the dashed line 124 may be filled exclusively with the non-polished cutting elements 106 and the polished cutting elements 102 may be located exclusively outside the cone region. In other words, the polished cutting elements 102 may only be located in other regions (e.g., nose, flank, shoulder, or gage regions) of the body 104. In addition, the cone region within the dashed line 124 may remain entirely free of non-cutting bearing elements (i.e., DOCC structures). Further, the nose, flank, and shoulder regions may or may not also be entirely free of non-cutting bearing elements. Optionally, non-cutting bearing elements as shown in dashed lines 126 may be provided for DOC control in selected locations on one or more blades 116 in addition to the non-polished cutting elements 106.

In some embodiments, only a single non-polished cutting element 106 may be located within the cone region of a given blade 116, while the polished cutting elements 102 occupy the other cutter locations (e.g., pockets) within the cone region enclosed by the dashed line 124. In such an embodiment, the single non-polished cutting element 106 may be located within any one of the pockets immediately proximate to the longitudinal axis L of the body 104. In other embodiments, the single non-polished cutting element 106 may be located within the second or third radially innermost pockets proximate to the longitudinal axis L of the body 104, while the polished cutting elements 102 occupy all other locations (both inside and outside of the cone region).

In some embodiments (not shown), the non-polished cutting elements 106 may be located in other regions (e.g., nose, flank, shoulder, or gage regions) of the body 104, alternatively or in addition to being located in the cone region. For example, one or more of the non-polished cutting elements 106 may be located in the nose region in order to provide DOC control to the polished cutting elements 102. In addition, the non-polished cutting elements 106 may be positioned as primary cutters along a rotationally leading edge of the blade 116, or may be positioned as so-called "back up" cutters rotationally trailing the polished cutting elements 102. Such back up cutters may be positioned to exhibit an exposure the same as, greater than, or less than, an associated primary cutter. Thus, the non-polished cutting elements 106 may be secured in a predetermined pattern and at predetermined heights and orientations on the body 104 in order to provide effective cutting along with effective DOC control for the formation type to be cut.

Further, an exposure of the non-polished cutting elements 106 may be chosen based on, for example, a desired exposure, which may be the same or may be different from a relative exposure of the polished cutting elements 102. As discussed above, a rake angle of the non-polished cutting elements 106 may also differ relative to a rake angle of the polished cutting elements 102. Further, the number of cutters (i.e., cutter density) may remain the same or may differ from that of conventional blades in order to accommodate selective placement of the non-polished cutting elements 106 among the polished cutting elements 102. Finally, the non-polished cutting elements 106 may be utilized on other earth-boring tools, such as, for example, hybrid bits and which may include bodies that are fabricated from either steel or a hard metal "matrix" material.

Figure 3:
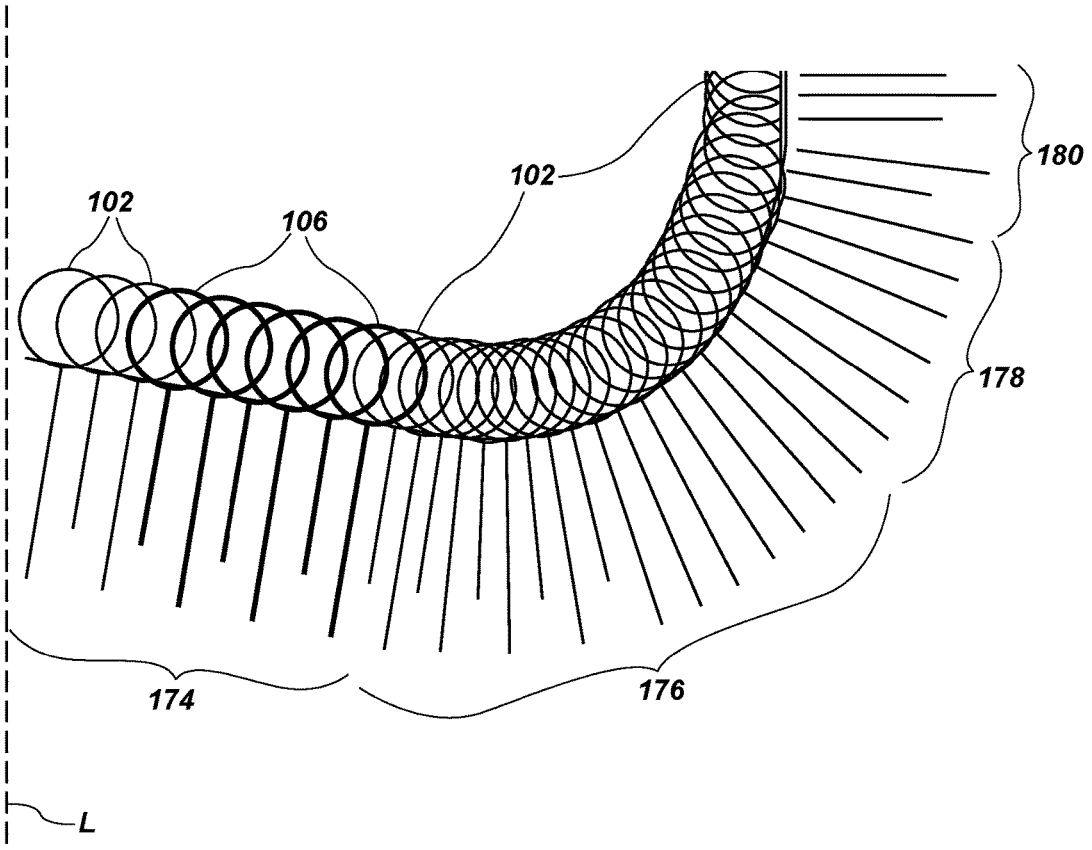
FIG. 3 is a cutter profile for a blade of the earth-boring drill bit of the disclosure.

FIG. 3 is a cutter profile comprising cutting elements 102, 106 for all of the blades 116 of the earth-boring tool 100 (shown in FIG. 1) as rotated about longitudinal axis L into a single plane, utilizing selective placement of the polished cutting elements 102 and the non-polished cutting elements 106 of the present disclosure. For illustrative purposes, the profile is for the fixed-cutter rotary drill bit of FIG. 1, configured as previously described, although it is to be recognized that the selective placement of cutting elements 102, 106 disclosed herein may be incorporated on other earth-boring tools, such as reamers, hole-openers, casing bits, core bits, or other earth-boring tools.

The earth-boring tool 100 includes a plurality of cutting elements 102, 106 mounted to each blade 116 of the body 104 (FIG. 1). Moreover, as understood in the art, the profile of the earth-boring tool 100, configured as shown in FIG. 3 may include a cone region 174, a nose region 176, a shoulder region 178, and a gage region 180. Cutting elements 102, 106 located in the respective cone and nose regions 174, 176 of the blade 116 may be exposed to a greater DOC but subjected to a lesser work rate than cutting elements 102, 106 located in other regions of the body 104. Conversely, cutting elements 102, 106 located in the shoulder region 178 of the blade 116 may be exposed to a higher work rate but a lesser DOC than cutting elements 102, 106 in other regions of the body 104. It is to be appreciated that non-polished cutting elements 106 configured as described herein may be selectively located at specific regions of the body 104 to optimize one or more desired performance characteristics. As shown in FIG. 3, the polished cutting elements 102 configured as described herein may be selectively located in the nose region 176 and shoulder region 178, and may have polished surfaces configured for specific high DOC performance characteristics, such as, by way of non-limiting example, passivity and chip flow performance. The polished cutting elements 102 may also be located in the radially innermost pockets of the cone region 174 proximate the longitudinal axis L of the body 104. Additionally, the non-polished cutting elements 106 configured as described herein may be selectively located in the cone region 174 adjacent to the polished cutting elements 102 located proximate the longitudinal axis L of the body 104, and may be configured and positioned for specific high work rate performance characteristics, such as aggressiveness, in addition to providing DOC control. The gage region 180 of each blade 116 may be fitted with the polished cutting elements 102 or other conventional PDC cutting elements tailored for specific performance characteristics. In additional embodiments (not shown), the non-polished cutting elements 106 configured as described herein may be selectively located in only one of the cone region 174, the nose region 176, the shoulder region 178, or the gage region 180, while the polished cutting elements 102 or other conventional PDC cutting elements tailored for specific performance characteristics may be located in the remaining regions. In yet other embodiments, the non-polished cutting elements 106 may be selectively located in any combination of the cone region 174, the nose region 176, the shoulder region 178, or the gage region 180, with the polished cutting elements 102 or other conventional PDC cutting elements tailored for specific performance characteristics located in the remaining regions of bearing surfaces of the body 104.

Figure 4:
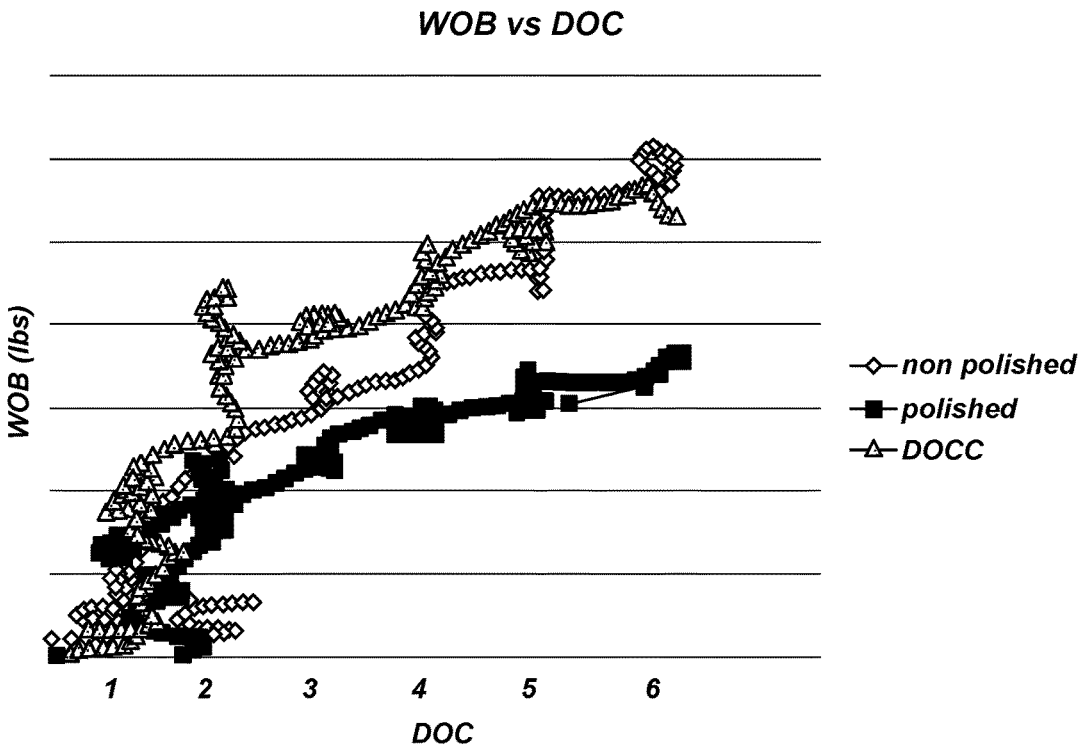
FIG. 4 is a graph depicting laboratory test results of WOB versus DOC for representative drill bit configurations including polished cutting elements (exclusively), polished cutting elements and DOCC structures, and strategically placed polished and non-polished cutting elements embodying the present disclosure.
Figure 5:
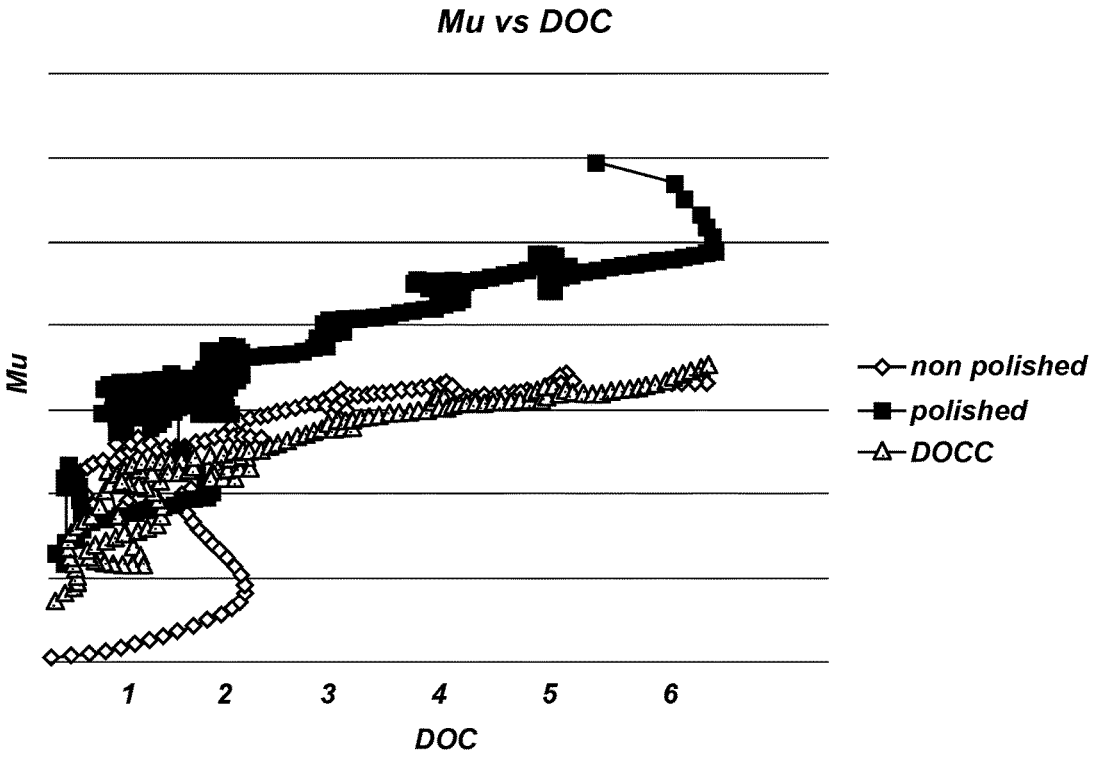
FIG. 5 is a graph depicting laboratory test results of Mu versus DOC for the tested drill bit configurations.
Figure 6:
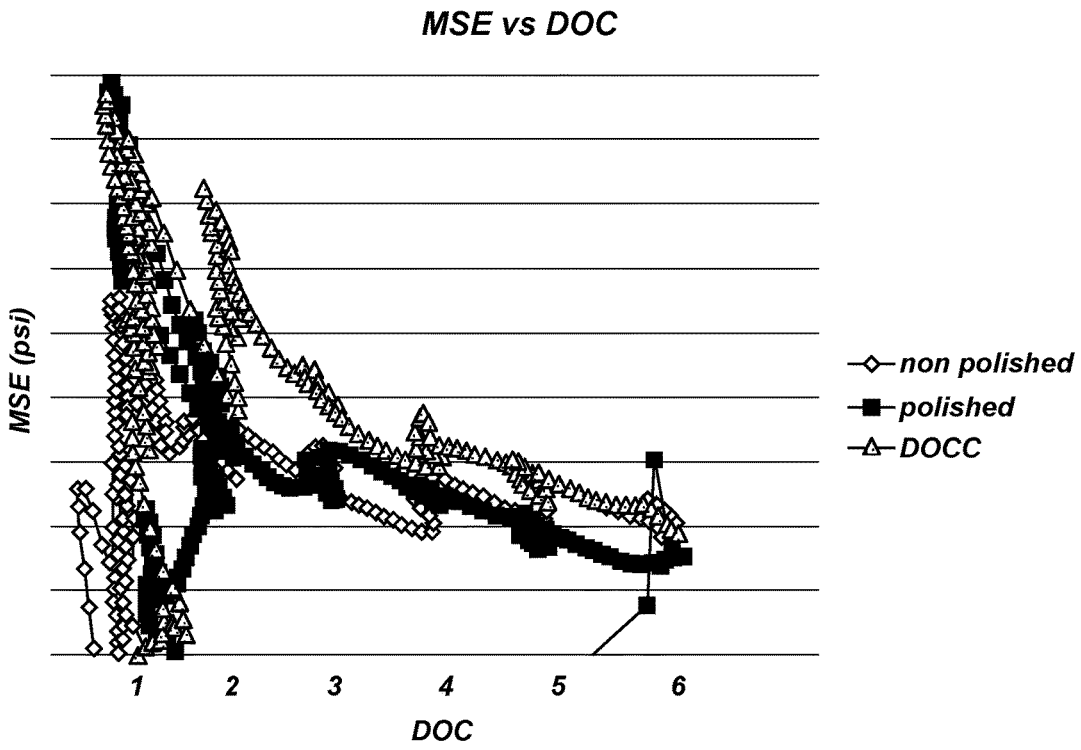
FIG. 6 is a graph depicting laboratory test results of MSE versus DOC for the tested drill bit configurations.

FIGS. 4 through 6 show graphs depicting laboratory test results for the earth-boring tool 100 configured similar to the fixed-cutter rotary drill bit of FIG. 1. In particular, the drill bits utilized during testing included an 8.5 in. drag bit (e.g., from the TALON™ platform of PDC bits) commercially available through Baker Hughes Incorporated of Houston, Tex. Further, the drag bits included 16-mm cutting elements positioned on a bit body having a five-blade configuration. During testing, the drag bits respectively incorporated three distinct configurations involving a first bit configuration including strategically placed non-polished cutting elements 106 among the polished cutting elements 102 embodying the present disclosure. Specifically, six of the polished cutting elements 102 were replaced with six of the non-polished cutting elements 106 in the cone region of the body 104 as discussed in detail above with reference to FIGS. 1 and 2. Further, the first bit configuration was free of any non-cutting bearing elements, such as DOCC elements or rubbing surfaces. A second bit configuration included the polished cutting elements 102 (exclusively) with no non-cutting bearing elements, and a third bit configuration included the polished cutting elements 102 along with non-cutting bearing elements (i.e., DOCC elements). The first, second, and third bit configurations are indicated in each of FIGS. 4 through 6 as "non-polished," "polished," and "DOCC," respectively. Of general importance in the graphs of FIGS. 4 through 6 is that the primary data points obtained during testing tend to be depicted as "loops" in each of the plots of the three bit configurations. Data continued to be recorded between the primary data points, which may be observed as lines or arcs between steps in each of the plots, while the looped sections indicate the primary data points. For example, each of the plots in the graph of FIGS. 4 through 6 exhibits approximately five or six primary data points. In addition, it may be noted that "noise" is typically observed at the beginning of each testing procedure until the bit is stabilized.

FIG. 4 graphically portrays laboratory test results with respect to weight-on-bit (WOB) (lbs.) versus depth-of-cut (DOC) (in./rev.) with a constant rate-of-penetration (ROP) per step. Of significance is the magnitude of the difference in utilizing selective placement of non-polished cutting elements as shown in the graph of FIG. 4. The slope of the plot of the bit utilizing polished cutting elements is expectedly less than the slope of the plot of the bit utilizing DOCC elements. However, the slope of the plot of the bit utilizing non-polished cutting elements is less than or similar to that of the plot of the bit utilizing DOCC elements. As shown in the graph of FIG. 4, the plot of the bit utilizing non-polished cutting elements is markedly different than the plot of the bit utilizing polished cutting elements, which test results were unexpected. Rather, a minimal change in WOB was expected given the minor adjustment of replacing only a few of the polished cutting elements with non-polished cutting elements in the cone region of the bit while maintaining the same cutting element back rake and exposure. These results are attributable to the bearing surfaces of the bit utilizing the non-polished cutting elements in the cone region providing effective DOC control without loss of efficiency while engaging the formation in accordance with the present disclosure as will become even more apparent in yet to be discussed FIG. 6.

FIG. 5 depicts laboratory test results of Aggressiveness ("Mu" or μ) versus DOC. Aggressiveness of a bit may be determined by the DOC the cutting elements of the bit are designed to take. For PDC bits the aggressiveness may be regulated, for example, by cutter exposure and cutter rake angle. Aggressiveness (μ) of a bit can be calculated by the equation:

$$\mu = \frac{36 \times \text{Torque (ft.-lbs.)}}{WOB\ \text{(lbs.)} \times \text{Bit Diameter (in.)}}$$

Typically, a higher Mu means that a drill bit will generate relatively more torque with lower WOB, but it can suffer from impact damage in abrasive formations. Mu is determined as a measurement for bit aggressiveness.

The test results of Mu versus DOC of the three separate drill bit configurations are depicted in the graph of FIG. 5. Of significance is the position and slope of the line for the plot of the bit utilizing non-polished cutting elements. The position and slope of the plot of the bit utilizing polished cutting elements is expectedly greater than the position and slope of the plot of the bit utilizing DOCC elements, as the increased aggressiveness of polished cutting elements is well established in the industry. However, the position and slope of the plot of the bit utilizing non-polished cutting elements is similar to that of the plot of the bit utilizing DOCC elements. The test results indicate an equal or slightly increased Mu per DOC of the bit utilizing selective placement of non-polished cutting elements relative to the bit utilizing DOCC elements, which test results were unexpected. It is believed that this result is attributable to the non-polished cutting elements in the cone region generating greater frictional forces opposing WOB when engaging the formation relative to polished cutting elements in other regions of the bit (e.g., nose or shoulder regions). In other words, non-polished cutting elements located in the cone region tend to provide greater resistance to penetrating the formation. Therefore, placement of the non-polished cutting elements in the cone region of the bit provided a significant change in Mu per DOC, which change was unexpected given the minor adjustment of replacing only a few of the polished cutting elements with non-polished cutting elements in the cone region of the bit while maintaining the same cutting element back rake and exposure.

FIG. 6 graphically portrays laboratory test results with respect to mechanical specific energy (MSE) (psi) versus DOC. Of general note in the graph of FIG. 6 is that "noise" may be observed at the beginning of the test for each bit configuration until the bits are stabilized at around DOC step 2. At that point, it may be observed that the MSE per DOC is significantly higher in the bit utilizing DOCC. In other words, the amount of force required to remove a volume of rock is significantly higher in the bit utilizing DOCC relative to the bit utilizing polished cutting elements, which was expected. However, the amount of MSE per DOC of the bit utilizing selective placement of non-polished cutting elements is similar (i.e., nearly identical) to the MSE per DOC of the bit utilizing polished cutting elements, which results were unexpected. In other words, there was little or no loss of efficiency using non-polished cutting elements in the cone region. This is evidenced by each of the primary data points of the plot of the bit utilizing non-polished cutting elements being in the vicinity of each of the primary data points of the plot of the bit utilizing polished cutting elements between the DOC steps 1 to 5. The test results indicate a slight increase in MSE for the bit utilizing the non-polished cutting elements at DOC step 6, which may be attributable to the balling effect. Thus, in order to decrease MSE for a given DOC, a bit having selectively located non-polished cutting elements among polished cutting elements may be utilized. The fact that the bit utilizing non-polished cutting elements significantly decreased MSE provides strong evidence of the effectiveness of incorporating non-polished cutting elements among polished cutting elements to modulate and control DOC while also efficiently engaging the formation in accordance with the present disclosure.

It can now be appreciated that the present disclosure is particularly suitable for applications involving earth-boring tools with might otherwise utilize conventional, dedicated DOC control features. Therefore, when implementing the present disclosure by providing a bit having selective placement of polished and non-polished cutting elements, a bit embodying the present disclosure will optimally exhibit reduced MSE for increased drilling efficiency. In particular, placement of non-polished cutting elements in specific regions (e.g., cone region) of the bit body may beneficially affect WOB and Aggressiveness (μ), which in turn affects BUR, particularly during directional drilling.

Additional non-limiting example embodiments of the disclosure are set forth below.

Embodiment 1

An earth-boring tool, comprising: a body having a longitudinal axis; blades extending longitudinally and generally radially from the body; at least one polished superabrasive cutting element located on at least one blade in at least one region of a face of the earth-boring tool; and at least one non-polished superabrasive cutting element located on the at least one blade in at least another region of the face of the earth-boring tool.

Embodiment 2

The earth-boring tool of Embodiment 1, wherein the at least one non-polished superabrasive cutting element is positioned proximate the longitudinal axis of the body.

Embodiment 3

The earth-boring tool of Embodiment 2, wherein a single polished superabrasive cutting element is positioned between the at least one non-polished superabrasive cutting element and the longitudinal axis of the body.

Embodiment 4

The earth-boring tool of Embodiment 1, wherein: the at least one region of the face of the earth-boring tool comprises at least one of a nose region, a shoulder region, a flank region, and a gage region; and the at least another region of the face of the earth-boring tool comprises a cone region.

Embodiment 5

The earth-boring tool of Embodiment 4, wherein the at least one polished superabrasive cutting element is located in at least two of the nose region, the flank region, the shoulder region, the gage region, and the cone region.

Embodiment 6

The earth-boring tool of Embodiment 4, wherein each blade extending to the longitudinal axis bears at least one polished superabrasive cutting element and at least one other non-polished superabrasive cutting element in the cone region.

Embodiment 7

The earth-boring tool of Embodiment 6, wherein the at least another region comprises a cone region and further comprising at least one polished superabrasive cutting element in the at least another region of the earth-boring tool radially closer to the longitudinal axis than the at least one other non-polished superabrasive cutting element in the at least another region.

Embodiment 8

The earth-boring tool of Embodiment 6, wherein the at least another region comprises a cone region and the at least one other non-polished superabrasive cutting element in the at least another region comprises at least two non-polished superabrasive cutting elements.

Embodiment 9

The earth-boring tool of Embodiment 1, wherein the at least another region comprises a cone region and there are no non-polished superabrasive cutting elements located outside of the at least another region.

Embodiment 10

The earth-boring tool of Embodiment 1, wherein: a surface roughness of the at least one polished superabrasive cutting element is about 10 μin. RMS or less; and a surface roughness of the at least one non-polished superabrasive cutting element is about 20 μin. RMS or more.

Embodiment 11

The earth-boring tool of Embodiment 1, wherein an exposure of the at least one polished superabrasive cutting element relative to an adjacent surface of the at least one blade is substantially the same as an exposure of the at least one non-polished superabrasive cutting element relative to an adjacent surface of the at least one blade.

Embodiment 12

The earth-boring tool of Embodiment 1, wherein the at least one polished superabrasive cutting element and the at least one non-polished superabrasive cutting element exhibit substantially equal effective back rake angles.

Embodiment 13

The earth-boring tool of Embodiment 1, wherein the at least one polished superabrasive cutting element and the at least one non-polished superabrasive cutting element each comprise a substantially planar cutting face having an adjacent peripheral chamfered cutting edge.

Embodiment 14

The earth-boring tool of Embodiment 1, wherein the earth-boring tool is a fixed-cutter rotary drill bit having a body comprising steel or a hard metal matrix material.

Embodiment 15

The earth-boring tool of Embodiment 1, further comprising at least one depth-of-cut control structure located on the at least one blade.

Embodiment 16

A method of drilling a subterranean formation, comprising: applying weight-on-bit to an earth-boring tool substantially along a longitudinal axis thereof and rotating the earth-boring tool; and engaging a formation with at least one polished superabrasive cutting element and at least one non-polished superabrasive cutting element of the earth-boring tool secured at selected locations of one or more regions of blades extending from a body of the earth-boring tool.

Embodiment 17

The method of Embodiment 16, further comprising limiting a magnitude of torque-on-bit responsive to limiting a maximum depth-of-cut using the at least one non-polished superabrasive cutting element located within a cone region of the earth-boring tool during application of a selected weight-on-bit substantially along the longitudinal axis.

Embodiment 18

The method of Embodiment 17, wherein limiting the magnitude of the torque-on-bit responsive to limiting the maximum depth-of-cut using the at least one non-polished superabrasive cutting element further comprises engaging the formation with a plurality of non-polished superabrasive cutting elements on portions of blades located in the cone region of the body.

Embodiment 19

The method of Embodiment 17, further comprising: applying a selected weight-on-bit substantially along the longitudinal axis to cause the at least one non-polished superabrasive cutting element within the cone region of the body to engage the formation to a selected depth-of-cut; and maintaining the selected depth-of-cut under the applied weight-on-bit substantially along the longitudinal axis entirely by using the at least one non-polished superabrasive cutting element.

Embodiment 20

The method of Embodiment 16, further comprising providing depth-of-cut control with the at least one non-polished superabrasive cutting element located on the one or more regions of blades extending from the body of the earth-boring tool.

Embodiment 21

The method of Embodiment 16, wherein engaging the formation comprises engaging the formation with the at least one polished superabrasive cutting element having a cutting face exhibiting a reduced surface roughness relative to a cutting face of the at least one non-polished superabrasive cutting element, the at least one polished superabrasive cutting element exhibiting a surface roughness of about 10 μin. RMS or less, and the at least one non-polished superabrasive cutting element exhibiting a reduced surface roughness of about 40 μin. RMS or more.

Embodiment 22

The method of Embodiment 16, wherein engaging the formation with the at least one polished superabrasive cutting element and the at least one non-polished superabrasive cutting element further comprises engaging the formation with at least one depth-of-cut control structure.

Although the foregoing description contains many specifics, these are not to be construed as limiting the scope of the present disclosure, but merely as providing certain exemplary embodiments. Similarly, other embodiments of the invention may be devised, which do not depart from the spirit or scope of the present disclosure. For example, features described herein with reference to one embodiment also may be provided in others of the embodiments described herein. The scope of the invention is, therefore, indicated and limited only by the appended claims and their legal equivalents, rather than by the foregoing description. All additions, deletions, and modifications to the disclosed embodiments, which fall within the meaning and scope of the claims, are encompassed by the present disclosure.

What is claimed is:

1. An earth-boring tool, comprising:

a body having a longitudinal axis;

blades extending longitudinally and generally radially from the body;

at least one polished superabrasive cutting element located on at least one blade in each of at least two regions selected from a nose region, a shoulder region, a flank region, a gage region, and a cone region of a face of the earth-boring tool; and at least one non-polished superabrasive cutting element located on the at least one blade in the cone region of the face of the earth-boring tool.

2. The earth-boring tool of claim 1, wherein the at least one non-polished superabrasive cutting element is positioned proximate the longitudinal axis of the body.

3. The earth-boring tool of claim 2, wherein a single polished superabrasive cutting element is positioned between the at least one non-polished superabrasive cutting element and the longitudinal axis of the body.

4. The earth-boring tool of claim 1, wherein each blade extending to the longitudinal axis bears at least one polished superabrasive cutting element and at least one other non-polished superabrasive cutting element in the cone region.

5. The earth-boring tool of claim 4, further comprising at least one polished superabrasive cutting element in the cone region of the earth-boring tool radially closer to the longitudinal axis than the at least one other non-polished superabrasive cutting element in the cone region.

6. The earth-boring tool of claim 4, wherein the at least one other non-polished superabrasive cutting element in the cone region comprises at least two non-polished superabrasive cutting elements.

7. The earth-boring tool of claim 1, wherein there are no non-polished superabrasive cutting elements located outside of the cone region.

8. The earth-boring tool of claim 1, wherein:

a surface roughness of the at least one polished superabrasive cutting element is about 10 μin. RMS or less; and a surface roughness of the at least one non-polished superabrasive cutting element is about 20 μin. RMS or more.

9. The earth-boring tool of claim 1, wherein an exposure of the at least one polished superabrasive cutting element relative to an adjacent surface of the at least one blade is substantially the same as an exposure of the at least one non-polished superabrasive cutting element relative to an adjacent surface of the at least one blade.

10. The earth-boring tool of claim 1, wherein the at least one polished superabrasive cutting element and the at least one non-polished superabrasive cutting element exhibit substantially equal effective back rake angles.

11. The earth-boring tool of claim 1, wherein the at least one polished superabrasive cutting element and the at least one non-polished superabrasive cutting element each comprise a substantially planar cutting face having an adjacent peripheral chamfered cutting edge.

12. The earth-boring tool of claim 1, wherein the earth-boring tool is a fixed-cutter rotary drill bit having a body comprising steel or a hard metal matrix material.

13. The earth-boring tool of claim 1, further comprising at least one depth of-cut control structure located on the at least one blade.

14. A method of drilling a subterranean formation, comprising:

applying weight-on-bit to an earth-boring tool substantially along a longitudinal axis thereof and rotating the earth-boring tool; and engaging a formation with at least one polished superabrasive cutting element located on at least one blade extending from a body of the earth-boring tool in each of at least two regions selected from a nose region, a shoulder region, a flank region, a gage region, and a cone region of a face of the earth-boring tool and at least one non-polished superabrasive cutting element located on the at least one blade in the cone region of the face of the earth-boring tool.

15. The method of claim 14, further comprising limiting a magnitude of torque-on-bit responsive to limiting a maximum depth-of-cut using the at least one non-polished superabrasive cutting element located within the cone region of the earth-boring tool during application of a selected weight-on-bit substantially along the longitudinal axis.

16. The method of claim 15, wherein limiting the magnitude of the torque-on-bit responsive to limiting the maximum depth-of-cut using the at least one non-polished superabrasive cutting element further comprises engaging the formation with a plurality of non-polished superabrasive cutting elements on portions of blades located in the cone region of the body.

17. The method of claim 15, further comprising:

applying a selected weight-on-bit substantially along the longitudinal axis to cause the at least one non-polished superabrasive cutting element within the cone region of the body to engage the formation to a selected depth-of-cut; and maintaining the selected depth-of-cut under the applied weight-on-bit substantially along the longitudinal axis entirely by using the at least one non-polished superabrasive cutting element.

18. The method of claim 14, further comprising providing depth-of-cut control with the at least one non-polished superabrasive cutting element located on the at least one blade in the cone region of the face of the earth-boring tool.

19. The method of claim 14, wherein engaging the formation comprises engaging the formation with the at least one polished superabrasive cutting element having a cutting face exhibiting a reduced surface roughness relative to a cutting face of the at least one non-polished superabrasive cutting element, the at least one polished superabrasive cutting element exhibiting a surface roughness of about 10 μin. RMS or less, and the at least one non-polished superabrasive cutting element exhibiting a reduced surface roughness of about 40 μin. RMS or more.

20. The method of claim 14, wherein engaging the formation with the at least one polished superabrasive cutting element and the at least one non-polished superabrasive cutting element further comprises engaging the formation with at least one depth-of-cut control structure.

* * * * *